US008966906B2

(12) United States Patent
Rohrssen et al.

(10) Patent No.: US 8,966,906 B2
(45) Date of Patent: Mar. 3, 2015

(54) SYSTEM FOR SUPPLYING PRESSURIZED FLUID TO A CAP ASSEMBLY OF A GAS TURBINE COMBUSTOR

(75) Inventors: Robert Joseph Rohrssen, Greenville, SC (US); Patrick Benedict Melton, Horse Shoe, NC (US)

(73) Assignee: General Electric Company, Schenectady, NY (US)

( * ) Notice: Subject to any disclaimer, the term of this patent is extended or adjusted under 35 U.S.C. 154(b) by 791 days.

(21) Appl. No.: 13/247,252

(22) Filed: Sep. 28, 2011

(65) Prior Publication Data

US 2013/0074503 A1 Mar. 28, 2013

(51) Int. Cl.

| | |
|---|---|
| ***F23R 3/28*** | (2006.01) |
| ***F23R 3/00*** | (2006.01) |
| ***F23R 3/10*** | (2006.01) |

(52) U.S. Cl.

CPC .. *F23R 3/002* (2013.01); *F23R 3/10* (2013.01)
USPC ..... 60/737; 60/752

(58) Field of Classification Search

CPC ..... F01D 25/12; F05D 2260/201; F23R 2900/03042; F23R 2900/03044; F23R 3/002; F23R 3/10; F23R 3/283; F23R 3/54
USPC ..... 60/39.37, 752–760, 806
See application file for complete search history.

(56) References Cited

U.S. PATENT DOCUMENTS

| | | | | |
|---|---|---|---|---|
| 7,007,486 | B2 * | 3/2006 | Sprouse et al. | 60/776 |
| 7,343,745 | B2 * | 3/2008 | Inoue et al. | 60/737 |
| 7,581,401 | B2 | 9/2009 | West et al. | |
| 2002/0144507 | A1 * | 10/2002 | Kolman et al. | 60/723 |
| 2009/0188255 | A1 * | 7/2009 | Green et al. | 60/737 |
| 2010/0031662 | A1 * | 2/2010 | Zuo | 60/740 |
| 2011/0197586 | A1 | 8/2011 | Berry et al. | |
| 2012/0060511 | A1 * | 3/2012 | Zuo et al. | 60/806 |

OTHER PUBLICATIONS

Co-pending and commonly assigned U.S. Appl. No. 12/879,238, filed Sep. 10, 2010.

* cited by examiner

*Primary Examiner* — Phutthiwat Wongwian
*Assistant Examiner* — Thomas Burke
(74) *Attorney, Agent, or Firm* — Dority & Manning, PA

(57) ABSTRACT

A system for supplying pressurized fluid to a combustor of a gas turbine is disclosed. The system may include an end cover and a fuel nozzle extending from the end cover. The fuel nozzle may include a downstream end. Additionally, the system may include a cap assembly configured to receive at least a portion of the fuel nozzle. The cap assembly may include an upstream wall spaced apart from the downstream end, a downstream wall disposed proximate to the downstream end and a cap chamber defined between the upstream and downstream walls. Moreover, a conduit may extend through the end cover and the upstream wall such that a discharge end of the conduit is in flow communication with the cap chamber.

19 Claims, 4 Drawing Sheets

SYSTEM FOR SUPPLYING PRESSURIZED FLUID TO A CAP ASSEMBLY OF A GAS TURBINE COMBUSTOR

FIELD OF THE INVENTION

The present subject matter relates generally to gas turbines and, more particularly, to a system for supplying pressurized fluid to a cap assembly of a gas turbine combustor.

BACKGROUND OF THE INVENTION

Gas turbines often include a compressor, a number of combustors, and a turbine. Typically, the compressor and the turbine are aligned along a common axis, and the combustors are positioned between the compressor and the turbine in a circular array about the common axis. In operation, the compressor creates compressed air, which is supplied to the combustors. The combustors combust the compressed air with fuel to generate hot gases of combustion, which are then supplied to the turbine. The turbine extracts energy from the hot gases to drive a load, such as a generator.

To increase efficiency, modern combustors are operated at temperatures that are high enough to impair the combustor structure and to generate pollutants such as nitrous oxides (NOx). These risks are mitigated by directing pressurized air supplied from the compressor over the combustor exterior, which cools the combustor, before premixing the air with fuel to form an air-fuel mixture, so as to generate lower levels of NOx during combustion.

For these reasons, the combustor typically includes a flow sleeve that defines an annular passageway configured to receive the pressurized air discharged from the compressor. Specifically, the air impinges against the transition duct and combustion liner for cooling purposes. The air then travels in a reverse direction through the annular passageway toward the combustor cap assembly, which houses at least a portion of the fuel nozzles. Often, a portion of this air may be diverted from the annular passageway and into the cap assembly to provided cooling to such assembly. For example, a downstream plate of the cap assembly may be exposed to the high temperatures of the combustion chamber. Thus, the downstream plate is normally cooled with air diverted from the annular passageway through openings in an outer wall of the cap assembly. The diverted air impinges against and passes through the downstream plate into the combustion chamber. Thus, the diverted air is not pre-mixed with fuel, which exacerbates NOx generation.

Typically, the air traveling through the annular passageway experiences pressure loses. Due to these pressure losses, an increased amount of air is needed to cool the cap assembly, resulting in a lower percentage of premixed air in the combustor. Also, the air pressure through the downstream wall may not be sufficient to overcome a dynamic pressure wave that is present in the combustion chamber due to flame instability and/or other combustion dynamics. Specifically, this dynamic pressure wave may exert a pressure on the downstream wall that impedes or stops the cooling flow, causing the downstream wall to overheat and potentially fail.

Accordingly, a system for supplying pressurized air to the cap assembly that allows the pressure within the cap assembly to be increased would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter discloses a combustor including an end cover and a fuel nozzle extending from the end cover. The fuel nozzle may include a downstream end. Additionally, the combustor may include a cap assembly configured to receive at least a portion of the fuel nozzle. The cap assembly may include an upstream wall spaced apart from the downstream end, a downstream wall disposed proximate to the downstream end and a cap chamber defined between the upstream and downstream walls. A conduit may extend through the end cover and the upstream wall and may include a discharge end terminating within the cap chamber. The conduit may be configured to direct pressurized fluid with the cap chamber.

In another aspect, the present subject matter discloses a system for supplying pressurized fluid to a combustor of a gas turbine. The system may include an end cover and a fuel nozzle extending from the end cover. The fuel nozzle may include a downstream end. Additionally, the system may include a cap assembly configured to receive at least a portion of the fuel nozzle. The cap assembly may include an upstream wall spaced apart from the downstream end, a downstream wall disposed proximate to the downstream end and a cap chamber defined between the upstream and downstream walls. Moreover, a conduit may extend through the end cover and the upstream wall such that a discharge end of the conduit is in flow communication with the cap chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
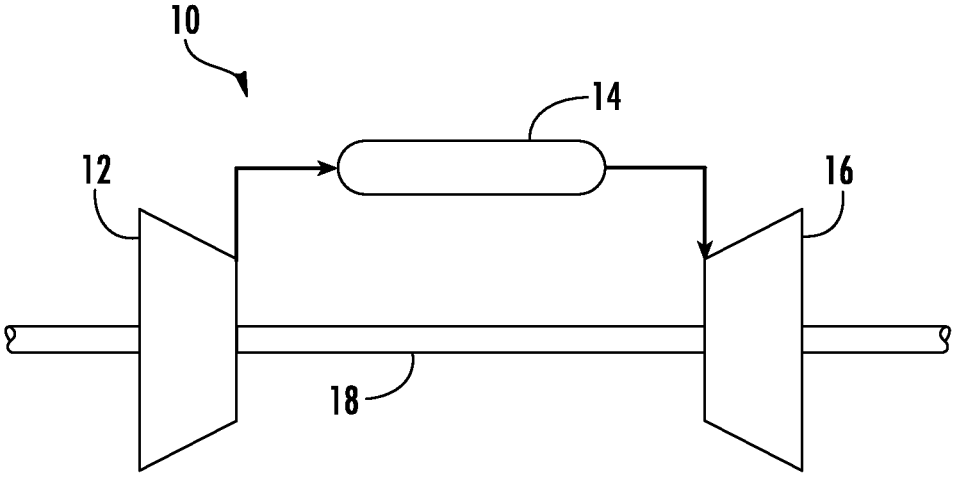
FIG. 1 illustrates a schematic diagram of one embodiment of a gas turbine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a system for supplying pressurized fluid to a cap assembly of a gas turbine combustor. In particular, the present subject matter discloses a system including one or more flow conduits extending through an end cover of the combustor and into a cap chamber of the cap assembly. Each flow conduit may be in flow communication with a pressurized fluid source such that a pressurized fluid may be directed through each flow conduit and into the cap chamber. As a result, the pressure within the cap chamber may be increased, thereby increasing the pressure drop between the cap chamber and the combustion chamber. Such an increased pressure drop may generally enhance the cooling provided to a downstream wall of the cap assembly and may also prevent hot gases from being forced into and/or through the downstream wall during periods of high combustion dynamics.

Figure 2:
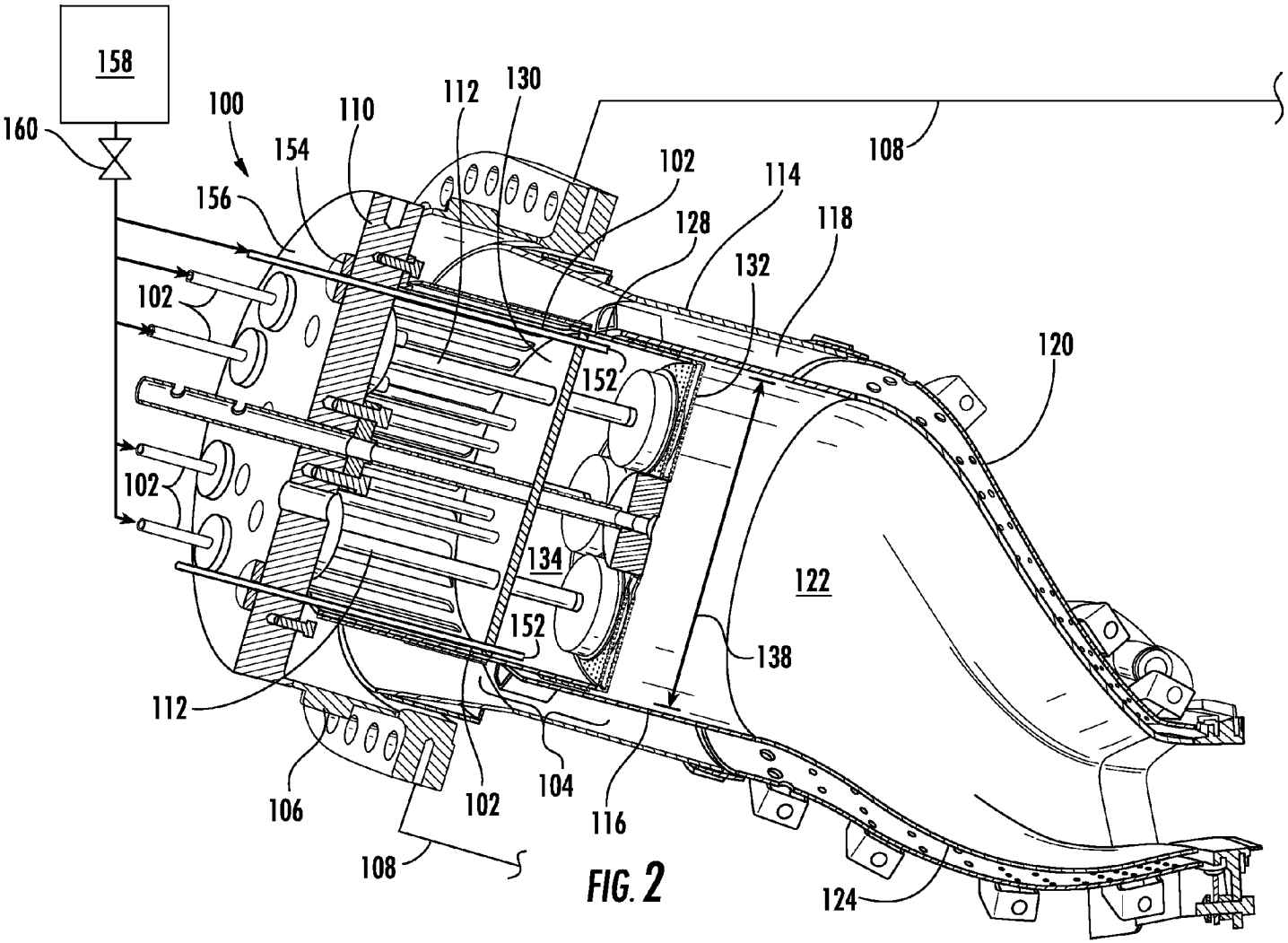
FIG. 2 illustrates a cutaway, perspective view of one embodiment of a gas turbine combustor.

Referring now to the drawings, FIG. 1 illustrates a schematic depiction of one embodiment of a gas turbine 10. In general, the gas turbine 10 includes a compressor 12, a combustion section 14, and a turbine 16. The combustion section 14 may include a plurality of combustors 100 (one of which is illustrated in FIG. 2) disposed around an annular array about the axis of the gas turbine 10. The compressor 12 and turbine 16 may be coupled by a shaft 18. The shaft 18 may be a single shaft or a plurality of shaft segments coupled together to form the shaft 18. During operation, the compressor 12 supplies compressed air to the combustion section 14. The compressed air is mixed with fuel and burned within each combustor 100 (FIG. 2) and hot gases of combustion flow from the combustion section 14 to the turbine 16, wherein energy is extracted from the hot gases to produce work.

Figure 3:
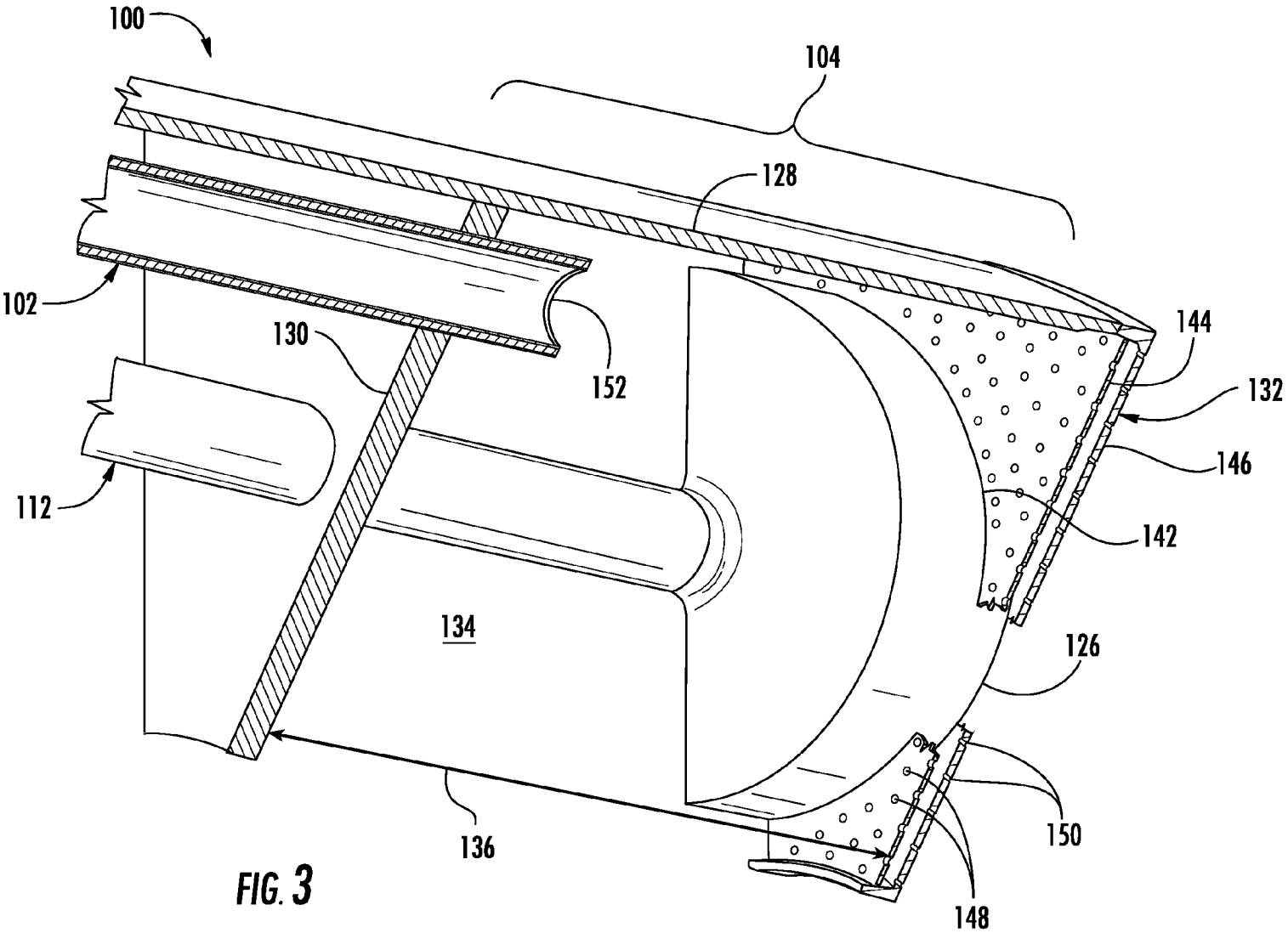
FIG. 3 illustrates an enlarged, perspective view of a portion of the combustor shown in FIG. 2, particularly illustrating a portion of a flow conduit extending into a cap assembly of the combustor.

Referring now to FIGS. 2 and 3, one embodiment of a combustor 100 having a plurality of flow conduits 102 installed therein is illustrated in accordance with aspects of the present subject matter. In particular, FIG. 2 illustrates a cutaway, perspective view of the combustor 100. Additionally, FIG. 3 illustrates an enlarged view of a portion of a cap assembly 104 of the combustor 100 shown in FIG. 2, particularly illustrating one of the flow conduits 102 extending into the cap assembly 104.

As shown, the combustor 100 generally includes a substantially cylindrical combustion casing 106 secured to a portion of a gas turbine casing 108, such as a compressor discharge casing or a combustion wrapper casing. The gas turbine casing 108 may generally define a plenum (not shown) configured to receive pressurized air discharged from the compressor 12 (FIG. 1). Additionally, the combustor 100 may include an end cover 110 secured to an upstream end of the combustion casing 106 and a plurality of fuel nozzles 112 secured to and extending from the end cover 110. Each fuel nozzle 112 may generally be configured to intake fuel supplied through the end cover 110 and mix the fuel with the pressurized air supplied from the compressor 12. For purposes of clarity, the fuel nozzles 112 are illustrated in FIGS. 2 and 3 as cylinders without any detail with respect to the type, configuration and internal components of the nozzles 112. It should be readily appreciated by those of ordinary skill in the art that the disclosed combustor 100 is not limited to any particular type, shape and/or configuration of the fuel nozzles 112 and, thus, any suitable fuel nozzle known in the art may be utilized within the scope of the present subject matter. Moreover, it should be appreciated that the combustor 100 may include any suitable number of fuel nozzles 112.

The combustor 100 may also include a flow sleeve 114 and a combustion liner 116 substantially concentrically arranged within the flow sleeve 114. As such, an annular passageway 118 may be defined between the flow sleeve 114 and the combustion liner 116 for directing the pressurized air flowing within the turbine casing 108 along the combustion liner 116. For example, the flow sleeve 114 (and/or an impingement sleeve 120 of the combustor 100) may define a plurality of holes configured to permit the pressurized air contained within the turbine casing 108 to enter the annular passageway 118 and flow upstream along the combustion liner 116 toward the fuel nozzles 112. Additionally, the combustion liner 116 may generally define a substantially cylindrical combustion chamber 122 downstream of the fuel nozzles 112, wherein the fuel and pressurized air mixed within the fuel nozzles 112 are injected and combusted to produce hot gases of combustion. Further, the downstream end of the combustion liner 116 may generally be coupled to a transition piece 124 extending to a first stage nozzle (not shown) of the turbine 16 (FIG. 1). As such, the combustion liner 116 and transition piece 124 may generally define a flowpath for the hot gases of combustion flowing from the combustor 100 to the turbine 16.

As indicated above, the combustor 100 may also include a cap assembly 104 disposed upstream of the combustion chamber 122. For example, in several embodiments, a portion of the cap assembly 104 may be secured to an upstream end of the combustion liner 116 in order to seal the hot gases of combustion within the combustion chamber 122. As such, the cap assembly 104 may generally serve to shield or protect the upstream components of the combustor 100 (e.g., the end cover 110 and portions of the fuel nozzles 112) from the hot gases of combustion generated within the combustion chamber 122. Additionally, at least a portion of each fuel nozzle 112 may be configured to be received within and extend through the cap assembly 104. Thus, as shown in. FIG. 3, a downstream end 126 of each fuel nozzle 112 (shown in a cut-away portion of FIG. 3) may generally be in flow communication with the combustion chamber 122, thereby allowing the fuel and air mixed within each fuel nozzle 112 to be injected into the combustion chamber 122.

As shown in FIGS. 2 and 3, the cap assembly 104 may generally include a radially outer wall 128, an upstream wall 130 and a downstream wall 132. In general, the walls 128, 130, 132 of the cap assembly 104 may be spaced apart from one another so as to define a plenum or cap chamber 134. Specifically, as shown in the illustrated embodiment, the cap chamber 134 may extend axially a distance 136 (FIG. 3) defined between the upstream and downstream walls 130, 132 and may extend radially a distance 138 (FIG. 2) defined between opposed sides of the radially outer wall 128. As is generally understood, a portion of the pressurized air flowing within the annular passageway 118 may be diverted into the cap chamber 134 to provide cooling to the downstream wall 132 of the cap assembly 104. For example, in several embodiments, a plurality of openings (not shown) may be defined through the radially outer wall 126 to permit pressurized air flowing within the annular passageway 118 to enter the cap chamber 134.

The upstream wall 130 of the cap assembly 104 may generally comprise a plate (e.g., a baffle plate) defining a plurality of openings 140 (FIG. 4) for receiving the fuel nozzles 112. As such, at least a portion of each fuel nozzle 122 may extend through the upstream wall 130 and into the cap chamber 134. Additionally, as shown in the illustrated embodiment, the upstream wall 130 may generally be positioned upstream of the downstream wall 132 of the cap assembly 104. Accordingly, the upstream wall 130 may be spaced axially apart from both the combustion chamber 122 and the downstream ends 126 of the fuel nozzles 112.

The downstream wall 132 of the cap assembly 104 may generally define the upstream end of the combustion chamber 122 and, thus, may be disposed proximate to both the combustion chamber 122 and the downstream ends 126 of the fuel nozzles 112. For example, in several embodiments, the downstream wall 132 may define a plurality of openings 142 (FIG. 3) configured to receive the downstream end 126 of each fuel nozzle 112. As such, the downstream ends 126 of the fuel nozzles 112 may extend through the downstream wall 132 to permit the nozzles 112 to be in direct flow communication with the combustion chamber 122.

Additionally, in several embodiments, the downstream wall 132 may have a double-walled configuration. For example, as shown in FIG. 3, the downstream wall 132 may include a first plate 144 and a second plate 146 disposed adjacent to and directly downstream of the first plate 144. In several embodiments, the first and/or second plates 144, 146 may include a plurality of holes. For instance, as particularly shown in FIG. 3, the first plate 144 may be configured as an impingement plate and may include a plurality of impingement holes 148 defined therein. As such, any pressurized fluid contained within the cap chamber 134 may be directed through the impingement holes 148 in order to provide impingement cooling against the second plate 146. For example, as indicated above, pressurized air from the annular passageway 118 may be diverted into the cap chamber 134, which may then be flow through the impingement holes 148 to providing cooling to the second plate 146. Moreover, the second plate 146 may be configured as an effusion plate and may include a plurality of effusion holes 150 defined therein. For instance, the effusion holes 150 may be smaller than and angled with respect to the impingement holes 148. As such, the pressurized fluid flowing through the impingement holes 148 may flow through the effusion holes 150 to provide film cooling to the combustion chamber side of the second plate 146.

In alternative embodiments, it should be appreciated that the downstream wall 132 need not have double-walled configuration. For example, in one embodiment, the downstream wall 132 may simply comprise a single plate (e.g., an effusion plate) disposed proximate to both the combustion chamber 122 and the downstream ends 126 of the fuel nozzles 112.

Referring still to FIGS. 2 and 3, as indicated above, the pressurized air flowing through the annular passageway 118 may experience pressure losses, which may result in a reduction in the maximum pressure that may be obtained within the cap chamber 134. As such, the pressure drop between the cap chamber 134 and the combustion chamber 122 may be reduced, thereby decreasing the amount of cooling provided to the downstream wall 132 and increasing the likelihood that the hot gases contained within the combustion chamber 122 are forced into and/or through the downstream wall 132 (e.g., through the effusion holes 150) during periods of high combustion dynamics. Thus, in accordance with several embodiments of the present subject matter, the combustor 100 may include one or more flow conduits 102 configured to supply a pressurized fluid into the cap chamber 134 in order to increase the pressure within the chamber 134.

In general, each flow conduit 102 may be configured to extend through the end cover 110 and the upstream wall 130 of the cap assembly 104 such that a discharge end 152 of each flow conduit 102 terminates within the cap chamber 134 (i.e., at a location downstream of the upstream wall 130 and upstream of the downstream wall 132). As such, each flow conduit 102 may generally define a fluid pathway for pressurized fluid to be directed through the end cover 110 and upstream wall 130 and into the cap chamber 134. The pressurized fluid exiting the discharge end 152 of each conduit 102 may then be utilized to cool the downstream wall 132 (e.g., by being directed through the impingement holes 148 so as to provide impingement cooling to the second plate 146) and/or otherwise to increase the pressure drop between the cap chamber 134 and the combustion chamber 122.

It should be appreciated that the pressurized fluid supplied to the cap chamber 134 through the flow conduits 102 may be in addition to, or as an alternative to, the pressurized air diverted into the cap chamber 134 from the annular passageway 118. For example, in one embodiment, the flow conduits 102 may be configured to provide pressurized fluid to the cap chamber 134 at a sufficient pressure and/or flow rate so as to eliminate the need of diverting a portion of the pressurized air from the annular passageway 118. As a result, an increased amount of the pressurized air flowing through the annular passageway 118 may be supplied to the fuel nozzles 112 and mixed with fuel for subsequent combustion.

It should also be appreciated any number of flow conduits 102 may be configured to extend through the end cover 110 and into the cap chamber 134. For example, in several embodiments, the number of flow conduits 102 may correspond to the number of fuel nozzles 112 contained within the combustor 100. However, in alternative embodiments, the number of flow conduits 112 may be more or less than the number of fuel nozzles 112 (including a single flow conduit 102).

Moreover, it should be appreciated that the flow conduits 102 may generally be configured as any suitable tube, pipe, hose, flow channel and/or the like known in the art that may be utilized to direct a pressurized fluid through the end cover 110 and into the cap chamber 134. Similarly, the flow conduits 102 may be installed within and/or secured to a portion of the combustor 100 using any suitable means. For example, as shown in FIG. 2, in one embodiment, each flow conduit 102 may be mounted to the end cover 110, such as by securing an annular flange 154 of each flow conduit 102 to an outer surface 156 of the end cover 110 using any suitable attachment means (e.g., bolts, screws, pins and/or the like).

Additionally, as particularly shown in FIG. 2, each of the flow conduits 102 may be in flow communication with a pressurized fluid source 158. In general, it should be appreciated that the pressurized fluid source 158 may comprise any suitable machine, device and/or object capable of supplying pressurized fluid to the flow conduits 102. Thus, in one embodiment, the pressurized fluid source 158 may comprise the compressor 12 of the gas turbine 10 (FIG. 1). For example, a suitable coupling and/or manifold (not shown) may be utilized to couple the flow conduits 102 to a location downstream of the compressor 112 (e.g., at the compressor outlet, at a diffuser downstream of the compressor outlet or at a location on the gas turbine casing 108) such that a portion of the pressurized air discharged by the compressor 12 may be directed into the flow conduits 102. In other embodiments, the pressurized fluid source 158 may comprise a separate or secondary compressor of the gas turbine 10 or any other suitable pressurized fluid source (e.g., fluid filled tank).

It should be appreciated that, in several embodiments, the pressurized fluid may be passively supplied from the pressurized fluid source 158 to the flow conduits 102, such as by continuously directing the pressurized fluid between the pressurized fluid source 158 and the fluid conduits 102 at a constant flow rate and pressure. Alternatively, the pressurized fluid supplied from the pressurized fluid source 158 to the flow conduits 102 may be actively controlled. For example, as shown in FIG. 2, in one embodiment, one or more valves 160 may be disposed between the pressurized fluid source 158 and the discharge ends 152 of one or more of the flow conduits 102 to permit the flow rate and/or pressure of the pressurized fluid supplied to be controlled. In addition to the use of such valve(s) 160 or as alternative thereto, the pressurized fluid source 158 may be actively controlled in order to vary the characteristics of the pressurized fluid supplied to the flow conduits 102. For example, the pressurized fluid source 158 may be controlled such that the pressure, flow rate and/or temperature of the pressurized fluid supplied to the flow conduits 102 may be varied as desired.

It should also be appreciated that the pressurized fluid may generally comprise any suitable fluid. For example, in several embodiments, the pressurized fluid may comprise air, steam and/or an inert gas (e.g., nitrogen). Additionally, it should be appreciated that each flow conduit 102 may be configured to supply the same fluid, or different fluids may be supplied through different flow conduits 102, depending on operational needs and the availability of particular pressurized fluids.

Figure 4:
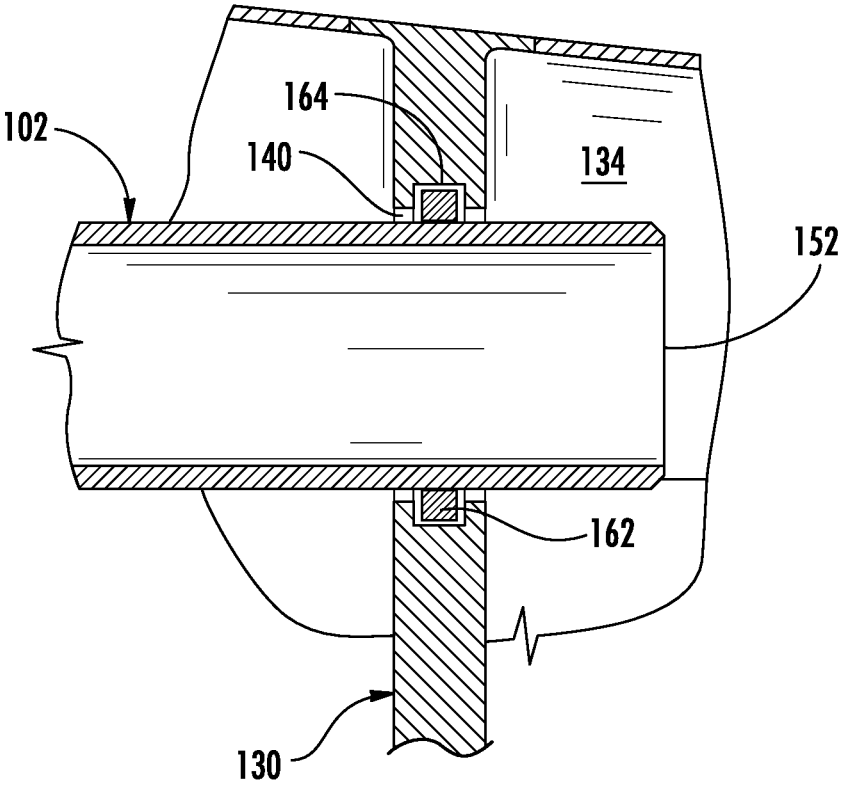
FIG. 4 illustrates a cross-sectional view of a portion of the flow conduit shown in FIG. 3, particularly illustrating a seal defined between the flow conduit and an upstream plate of the cap assembly.

Referring now to FIG. 4, there is illustrated a cross-sectional view of a portion of the flow conduit 102 shown in FIG. 3, particularly illustrating the portion of the flow conduit 102 extending through the upstream wall 130 of the cap assembly 104. As shown, a seal 162 may be disposed between the upstream wall 130 and the flow conduit 102 to prevent fluid from leaking into and/or out of the cap chamber 134 through the opening 140 defined in the upstream wall 130. It should be appreciated that the seal 162 may generally comprise any suitable sealing device and/or sealing mechanism known in the art. For example, as shown in the illustrated embodiment, the seal 162 comprises a ring seal (e.g., a piston ring seal or an O-ring seal) configured to be engaged within a seal groove 164 defined in the upstream wall 130.

In another embodiment, the seal 162 may comprise a floating seal extending between the upstream wall 130 and the flow conduit 102. In further embodiments, the seal 162 may comprise any other suitable sealing device and/or sealing mechanism, such as a face seal, a brush seal, a labyrinth seal, a friction seal, a slip joint, a compression seal, a gasket seal and/or the like.

It should be appreciated that a suitable seal (not shown) may also be disposed between the end cover 110 and the portion of each flow conduit 102 extending through the end cover 110. For example, in one embodiment, a gasket seal or other suitable seal may be disposed between the end cover 110 and each flow conduit 102 to prevent the leakage of fluids through the end cover 110.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor, comprising:

a combustor casing;

an end cover coupled to the combustor casing;

a cap assembly disposed within the combustor casing axially spaced from the end cover, the cap assembly comprising an annularly shaped outer wall, a downstream wall extending radially and circumferentially across a downstream end of the cap assembly, an upstream wall circumferentially surrounded by and attached to an inner surface of the outer wall upstream from the downstream wall, the upstream and downstream walls defining concentrically aligned openings, wherein the outer wall between the upstream wall and the downstream wall at least partially defines a cap chamber within the cap assembly;

a fuel nozzle extending axially from the end cover through the openings defined in the upstream and downstream walls and through the cap chamber; and a fluid conduit that extends through the end cover and the upstream wall and terminates within the cap chamber, wherein the fluid conduit is in fluid communication with a pressurized fluid source that provides a pressurized fluid into the cap chamber for cooling the downstream wall.

2. The combustor of claim 1, wherein the pressurized fluid source is a compressor of a gas turbine and the pressurized fluid is compressed air.

3. The combustor of claim 1, wherein the downstream wall comprises a first plate and a second plate disposed downstream of the first plate.

4. The combustor of claim 2, wherein the first plate is configured as an impingement plate.

5. The combustor of claim 2, wherein the second plate is configured as an effusion plate.

6. The combustor of claim 1, further comprising a plurality of conduits extending through the end cover and the upstream wall, each conduit of the plurality of conduits including a discharge end that terminates within the cap chamber.

7. The combustor of claim 1, further comprising a seal disposed between the conduit and the upstream wall.

8. The combustor of claim 6, wherein the seal comprises a ring seal or a floating seal.

9. The combustor of claim 1, wherein the pressurized fluid comprises at least one of air, steam and an inert gas.

10. A system for supplying pressurized fluid to a combustor of a gas turbine, the system comprising:

a combustor casing;

an end cover coupled to the combustor casing;

a cap assembly disposed within the combustor casing axially spaced from the end cover, the cap assembly comprising an annularly shaped outer wall, a downstream wall extending radially and circumferentially across a downstream end of the cap assembly, an upstream wall circumferentially surrounded by and attached to an inner surface of the outer wall upstream from the downstream wall, the upstream and downstream walls defining concentrically aligned openings, wherein the outer wall between the upstream wall and the downstream wall at least partially defines a cap chamber within the cap assembly;

a fuel nozzle extending axially from the end cover through the openings defined in the upstream and downstream walls and through the cap chamber; and a fluid conduit that extends through the end cover and the upstream wall and terminates within the cap chamber, wherein the fluid conduit is in fluid communication with a pressurized fluid source that provides a pressurized fluid into the cap chamber for cooling the downstream wall.

11. The system of claim 10, wherein the pressurized fluid source comprises a compressor of the gas turbine.

12. The system of claim 10, further comprising a valve disposed between the pressurize fluid source and a discharge end of the fluid conduit, the valve being configured to control the flow of pressurized fluid through the conduit.

13. The system of claim 10, wherein the pressurized fluid comprises at least one of air, steam and an inert gas.

14. The system of claim 10, further comprising a seal disposed between the conduit and the upstream wall.

15. The system of claim 14, wherein the seal comprises a ring seal or a floating seal.

16. The system of claim 10, wherein the downstream wall comprises a first plate and a second plate disposed downstream of the first plate.

17. The system of claim 16, wherein the first plate is configured as an impingement plate.

18. The system of claim 16, wherein the second plate is configured as an effusion plate.

19. The system of claim 10, further comprising a plurality of conduits extending through the end cover and the upstream wall, each conduit of the plurality of conduits including a discharge end that terminates within the cap chamber.

* * * * *